United States Patent [19]

Iwata et al.

[11] Patent Number: 4,955,736

[45] Date of Patent: Sep. 11, 1990

[54] METHOD AND APPARATUS FOR ENERGIZING THERMAL HEAD IN ACCORDANCE WITH DOT PATTERN COINCIDENCE TABLES

[75] Inventors: Satoshi Iwata; Akikazu Toida; Fumio Takahashi, all of Ise, Japan

[73] Assignee: Shinko Denki Kabushiki Kaisha, Tokyo, Japan

[21] Appl. No.: 310,157

[22] Filed: Feb. 14, 1989

[30] Foreign Application Priority Data

Feb. 15, 1988 [JP] Japan ..... 63-30769
Feb. 23, 1988 [JP] Japan ..... 63-38668

[51] Int. Cl.[5] ..... B41J 3/20
[52] U.S. Cl. ..... 400/120; 346/76 PH
[58] Field of Search ..... 400/120; 346/76 PH

[56] References Cited

U.S. PATENT DOCUMENTS

| | | | |
|---|---|---|---|
| 4,347,518 | 8/1982 | Williams | 400/120 |
| 4,447,819 | 5/1984 | Moriguchi | 400/120 |
| 4,536,774 | 8/1985 | Inui | 400/120 |
| 4,567,488 | 1/1986 | Moriguchi | 346/1.1 |
| 4,574,293 | 3/1986 | Inui | 400/120 |
| 4,630,947 | 12/1986 | Yoshida | 400/120 |
| 4,679,055 | 7/1987 | Inui | 400/120 |
| 4,806,950 | 2/1989 | Sekine | 400/120 |
| 4,819,008 | 4/1989 | Nagato | 346/76 PH |

FOREIGN PATENT DOCUMENTS

| | | | |
|---|---|---|---|
| 4970 | 1/1988 | Japan | 400/120 |

OTHER PUBLICATIONS

Abstract of Japanese Patent Publication No. 58-153676.
Abstract of Japanese Patent Publication No. 58-193171.
Abstract of Japanese Patent Publication No. 62-33658.
Abstract of Japanese Patent Publication No. 63-47167.

*Primary Examiner*—David A. Wiecking
*Assistant Examiner*—Steven S. Kelley
*Attorney, Agent, or Firm*—Armstrong, Nikaido, Marmelstein, Kubovcik & Murray

[57] ABSTRACT

The image data including a grid pattern to be printed by a thermal printer line by line is stored for three lines of dots in a plural line buffer, and the image data is scanned by a window frame of an inverted T-shape which covers the three lines. When a dot arrangement extracted by the window frame including an object dot and its surrounding dots coincides with a predetermined window frame pattern defined in an intermediate table, an address representing the dot arrangement is convertred into an intermediate code by the intermediate table. The intermediate code indicates the amount of heating energy to be supplied to a heating element corresponding to the object dot in order to preheat when the area of the object dot is a non-printing area, or to heat additionally when this area is a printing area, thereby to prevent a thin or broken portion from appearing in the printed pattern line.

5 Claims, 6 Drawing Sheets

METHOD AND APPARATUS FOR ENERGIZING THERMAL HEAD IN ACCORDANCE WITH DOT PATTERN COINCIDENCE TABLES

BACKGROUND OF THE INVENTION

1. Field of the Invention

The present invention relates to a method and apparatus for energizing a thermal head of a heat transfer or a heat sensitive thermal printer to print the printing data line by line.

2. Description of the Prior Art

A prior art energizing apparatus of a thermal head of a thermal printer is, as shown in FIG. 1, connected to external equipment such as a personal computer or the like which produces the printing data, for example, image data representing a wire frame pattern to be printed. The energizing apparatus includes an interface circuit (hereinafter referred to as an I/F circuit) 1 such as a Centronics interface or the like which receives the image data, a computer (referred to as a CPU) 2 for controlling the operation of the thermal printer as a whole, a random access memory (referred to as a RAM) 3 for a work area, a read only memory (referred to as a ROM) 4 for storing a program, a manipulation circuit 5, a thermal head S having a shift register *6a*, latch circuit *6b*, a driving circuit *7a* of the thermal head, and a heating unit *7b* including heating elements, a driver circuit 8, a paper feeding pulse motor 9, a transfer ribbon take-up pulse motor 10, and a solenoid 11 for pressing the thermal head against a ribbon and printing paper.

The image data input from the external equipment through the I/F circuit 1 is supplied via the CPU 2 to the shift register *6a* for each line sequentially and stored therein.

Thereafter, the image data in the shift register *6a* is transferred to the latch circuit *6b* by applying a latch signal. Then, a common signal is delivered to the driving circuit *7a* from the CPU 2 for a time depending on the temperature of the thermal head S to supply a current to predetermined heating elements of the heating unit *7b* to achieve printing.

In this case, in the thermal printer, when the electric power is to be supplied to the heating elements for one line of dots which amount to several thousands of dots, a power source of a large capacity is required. However, to avoid this, the one line of dots or heating elements are divided into a certain number of blocks and the energization of the heating elements is carried out for each block as a unit.

Such a block is called a common, and the printing of one line of dots is achieved by sequentially supplying a common signal from the CPU 2. On the other hand, various driving commands are input to the driver circuit 8 from the CPU 2 via the manipulation circuit 5, and the paper feeding by the pulse motor 9, and the taking-up of a transfer ribbon by the pulse motor 10 are performed, and at the same time, by exciting the solenoid 11, the printing of the image data is performed in accordance with the type of the thermal printer either the heat sensitive type or the thermal transfer type.

In the prior art energizing apparatus, among the heating elements of the thermal head, each of the heating elements which performs printing is supplied with a current for a fixed time, whereas each of the heating elements which does not perform the printing is not supplied with current. In this respect, in some prior art apparatus, the preheating is performed, for example, the printing head is maintained at a constant temperature independent of the printing data, or a separate heating head is provided separately from the printing head at a position several lines preceding the present printing line. Thus, the problem is involved in that the control of the preheating can not be achieved in accordance with the surrounding contents of the data to be printed, and the construction of hardware is complicated.

Accordingly, in printing a wire frame pattern in which a printing portion appears for the first time after a succession of non-printing portions for relatively a long time, for example, a grid pattern consisting of vertical line and horizontal line as shown in FIGS. 2A to 2C, the heating elements will be cooled before they reach the printing portion. As a result, a thin or broken portion will appear in the printed portion.

Generally, a relationship between the heating time of the heating element and the actual effect of printing on a printing paper is illustrated as shown in FIG. 3. When the heating time is shorter than T2, a non-printed area appears on the printing paper, and when the heating time is between T2 and T3, an intermediate area is produced in which printing or non-printing is effected depending on an environmental temperature. Furthermore, when the heating time exceeds T3, a printed area is produced. Hereinafter, the heating time is represented by the scale in FIG. 3 for the sake of explanation, for example, T2 is represented by "2", T3 by "3", a maximum heating time of a normal printing area by "6", and a maximum heating time for printing a pattern line portion to correct heating by additionaly heating thereby to emphasize in the present invention is represented by "7". Furthermore, a heating time T1 for preheating in a non-printing area is represented by 1".

The thin or broken printed portion is caused in various cases. However, in the present invention, the following cases are the objects for preventing such a thin or broken printed portion.

(i) The thin or broken portion caused in a horizontal pattern line when a grid pattern consisting of vertical and horizontal pattern lines is to be printed (FIG. 2A).

(ii) The thin or broken portion caused in the vertical pattern line when an adjacent area to the horizontal pattern line is preheated to prevent the thin portion in the horizontal pattern line in the case of (i) (FIG. 2B).

(iii) The thin or broken portion appearing in a first dot column and a first dot row in the printing of broad vertical and horizontal pattern lines each having a width of two dots (FIG. 2C).

In the cases (i) and (ii) mentioned above, the causes of the occurrence of the thin or broken printed portion are as follows.

In printing of the vertical pattern line, when the printing is performed line by line, the amount of heat supplied to the heating element for printing the previous line is accumulated so that it is summed to the heat for the printing of the present line. As a result, the amount of heat required for the printing is always obtained, and no thin or broken printed portion is usually. However, in the case of printing the horizontal pattern line, the printing is performed after passing through a large non-printed portion. Thus, the heating element is cooled and since there is no accumulated heat as mentioned above, the amount of heat required for printing is insufficient. As a result, even when a current is supplied to the heating element for the same period of time as in other printing portions, the thin printed portion will occur (FIG. 2A).

Furthermore, in order to prevent the occurrence of the thin or broken portion in the horizontal pattern line, if the correction for heating, that is, preheating for the non-printing portion is performed as in a first embodiment of the invention (described later), since this preheating is not performed for just lateral adjacent portions of the vertical pattern line to be printed, the printed vertical pattern line looks thin in contrast to the printed horizontal pattern line which has been made clear. That is, the vertical pattern line becomes thin relative to the horizontal pattern line (FIG. 2B).

SUMMARY OF THE INVENTION

It is an object of the invention to provide a method and apparatus for energizing a thermal head of a thermal printer capable of preventing the thin or broken printed portion from occurring in printing of a wire frame pattern.

In the first aspect of the present invention:

(1) A window frame of a predetermined shape such as an inverted T-shape is used to scan the printing data having a wire frame pattern to be printed by a thermal printer prior to the printing.

(2) When the printing data extracted by the window frame coincides with a predetermined window frame pattern defined in an intermediate table, an area represented by the window frame and in the non-printing portion is determined to be preheated. The intermediate table also indicates the amount of heating energy to be supplied to a corresponding heating element for the preheating.

(3) By the application of the preheating, at the time of printing, a temperature difference between heating elements for the successive printing portion and the non-successive printing portion is made small.

In the second aspect of the invention:

(1) A window frame of a predetermined shape such as an inverted T-shape is used to scan the printing data having a wire frame pattern to be printed by a thermal printer prior to the printing.

(2) When the printing data extracted by the window frame coincides with a predetermined window frame pattern defined in an intermediate table, an area represented by the window frame and in the printing portion is determined to be correction heated. The intermediate table also indicates the amount of heating energy to be supplied to a corresponding heating element for the correction heating.

(3) The heating element corresponding to the determined area is correction heated so that this heating element is supplied with a larger amount of heating energy than a heating element for printing a normal printing portion.

(4) By the adjustment of the heating time, each predetermined line portion of a vertical pattern line and a horizontal pattern line, which are to become printing portions, is corrected to increase the heating time longer than other printing portions.

DESCRIPTION OF THE PREFERRED EMBODIMENTS

Embodiments of the present invention will be described with reference to FIGS. 4 to 6A to 6G.

Figure 1:
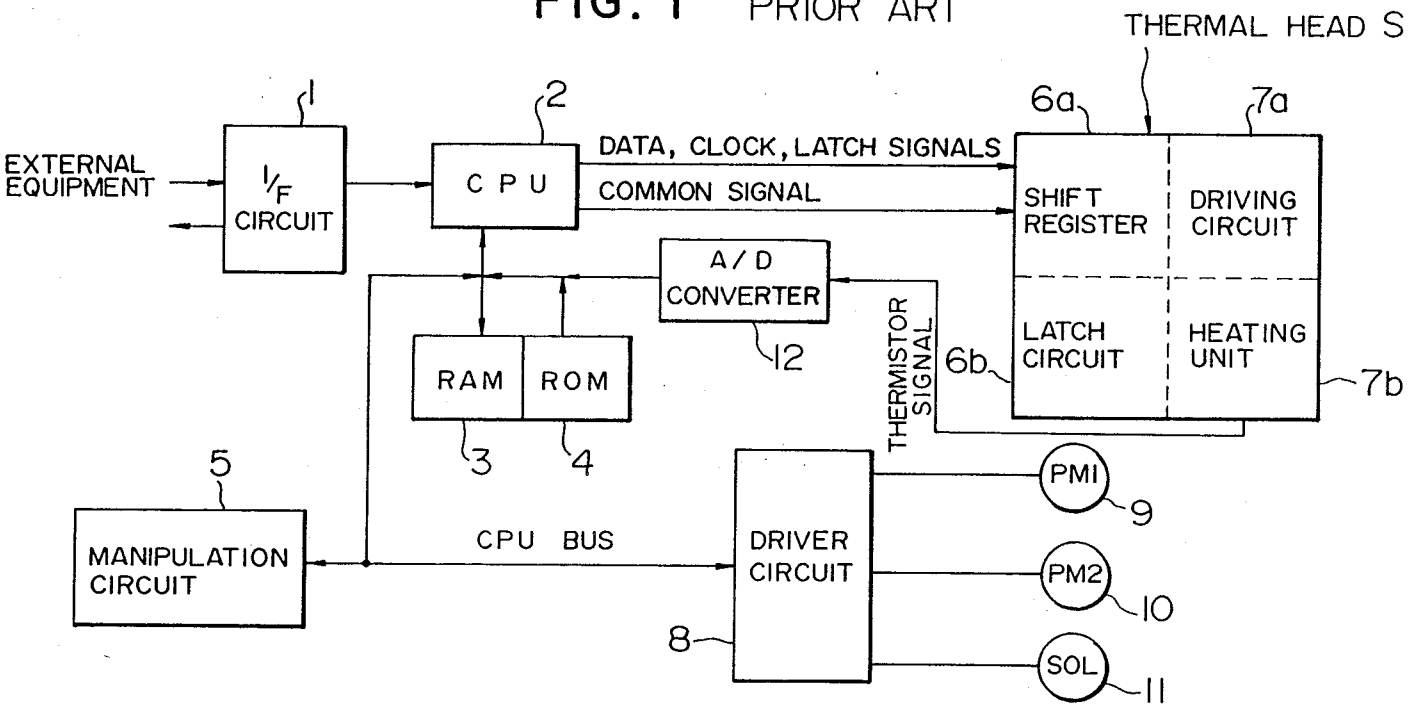
FIG. 1 PRIOR ART
FIG. 1 is a block diagram of a prior art energizing apparatus.
Figure 2A:
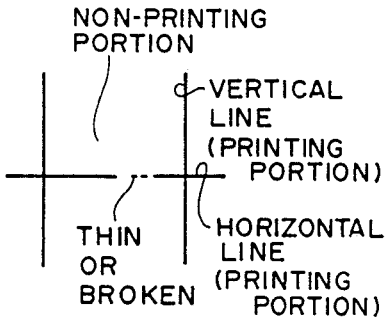
FIGS. 2A to 2C are diagrams for explaining a thin or broken portion occurring in a printed portion in the case of the prior art apparatus.
Figure 2B:
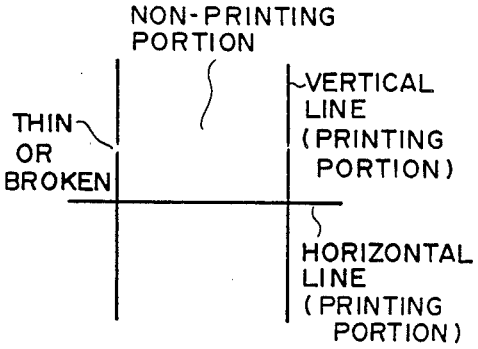
Figure 2C:
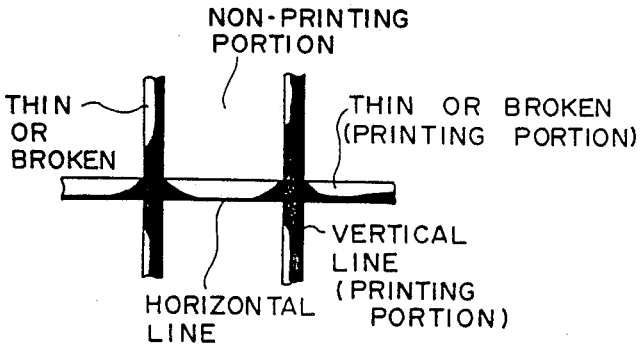
Figure 4:
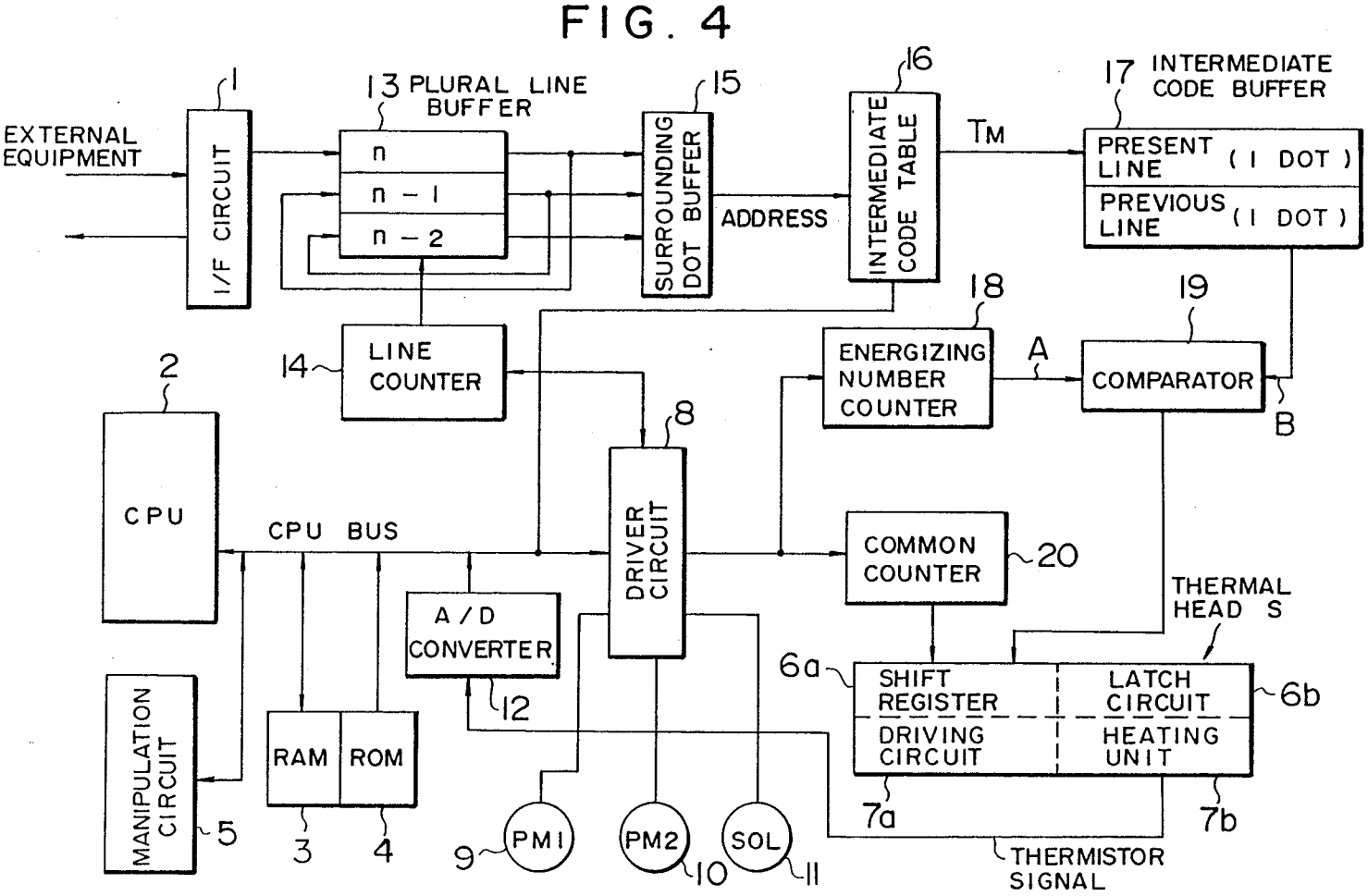
FIG. 4 is a block diagram of an energizing apparatus of an embodiment of the present invention.

In FIG. 4, equivalent parts to those in FIG. 1 are designated by like reference numerals.

An energizing apparatus which can be used in common in each embodiment will be described with reference to FIG. 4. A plural-line buffer 13 for example, a three-line buffer receives 8 dots of image data sent from external equipment through an I/F circuit 1, and stores for one dot line. At the same time, in response to a shift signal for each dot, it sequentially transfers the data, However, in order to examine dot states surrounding a dot to be printed, the plural-line buffer 13 stores the data for three dot lines including the present line (n), the previous line (n-1), and the line before the previous line (n-2). The plural-line buffer 13 is arranged in a ring-type.

A line counter 14 controls the operation of the plural-line buffer 13, and it is also used as an address generating circuit for generating an address for each dot in a window frame of an inverted T-shape.

Figure 5A:
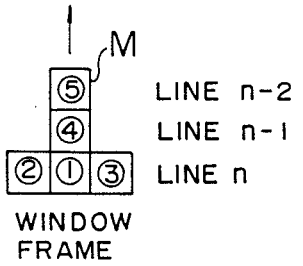
FIG. 5A shows a window frame used in the invention.

A surrounding dot buffer (including a latch circuit) 15 extracts from the plural line buffer 13 data for five dots in accordance with the window frame M shown in FIG. 5A, that is, three dots ① to ③ on the dot line (n), to be printed at present, one dot ④ on the previous dot line (n-1), and one dot ⑤ on the dot line (n-2) before the previous line. Among the five dots (the dot means not only a printing dot but also a non-printing dot), the dot ① positioned at the center of the dot row of the window frame M on the line n is the object dot which indicates, for example, a dot area to be preheated, correction heated, heated normally, or not heated in the succeeding process, and the other dots ② to ⑤ are mere surrounding dots indicating the surrounding data state of the object dot ① and defines the particular shape of the window frame M. The surrounding dot buffer 15 converts the extracted data representing the states of the object dot and the surrounding dots to an address corresponding to the states of the five dots, and delivers the address to an intermediate table 16.

Figure 5B:
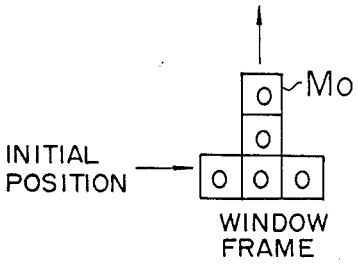
FIGS. 5B, 5D, and 5E show respectively different window frame patterns used in the invention.

The intermediate table 16 (actually stored in a memory) enables to convert the address to an intermediate code which differs depending on whether address representing the dot arrangement in the window frame M coincides with a window frame pattern M0 shown in FIG. 5B or not. For example, when the address contains 0, 0, 0, 0, 0 respectively corresponding to the states of the dots 1 to 5 of the window frame M, since this address coincides with the window frame pattern M0, the intermediate code of "1" is delivered. When two addresses respectively include 0, 1, 0, 0, 0, and 0, 0, 1, 0, 0, which are coincident with window frame patterns M1 and M2 (described later), intermediate codes of "1" and "1" are delivered respectively. Furthermore, when the address contains 1, X, X, X, X, (the object dot is 1, and the other dots are "don't care dots" in the first and second embodiments) which do not coincide with any of the window frame patterns M0 to M2 and which indicates a printing portion, the intermediate code of "6" is delivered. When the address is other than the ones mentioned above, the intermediate code of "0" is delivered. The intermediate code represents the amount of heating energy to be supplied to the heating element corresponding to the area of the object dot in the window frame M in order to preheat (intermediate code of 1), to heat (intermediate code of 6), or not heat (intermediate code of 0) which will be described later. In the second embodiment, in place of the single window frame pattern M0, two window frame patterns M1 and M2 shown in FIGS. 5D and 5E are used. Furthermore, in the third embodiment, five window frame patterns FIGS. 6B to 6F are use as will be described later, Thus, when the address sent from the surrounding dot buffer 15 is determined as being coincident with any one of the window frame patterns M1 and M2 in the second embodiment, the address is converted to intermediate codes of 1 and 1 respectively as mentioned above.

In this case, the amount of heating energy (heating time, the number of times of energization) for the intermediate code converted by the intermediate table 16 is predetermined by CPU 2. The manner of deciding a numerical value of the intermediate code representing the amount of heating energy will be described later.

An intermediate code buffer 17 stores the intermediate codes for two lines including the present line and the previous line, and outputs intermediate code signals B for the previous line which have already been generated repeatedly until the printing for one line is completed.

In this respect, the intermediate code signals for the previous line are referred to as the newest intermediate code signals for one line which have been determined completely, and the intermediate code signals for the present line are incomplete, that is, the intermediate codes for full one line have not been completed (under preparation).

An energizing number counter 18 counts the number of times of energization per one common, and outputs a signal A to a comparator 19. For example, when a maximum value of the intermediate codes is 6, the signals A represent respectively seven numerical values of 0 to 6, and the signals A are sequentially supplied to the comparator 19.

The comparator 19 compares the intermediate code signal B delivered for each one common from the intermediate code buffer 17 with the signal A, and outputs an energizing signal "1" when $A<B$, and outputs a non-energizing signal "0" when $A \geqq B$. This operation is repeated for the times corresponding to the maximum value of the intermediate code signals B. The number of times of comparison which is performed by the comparator 19 is determined by the maximum value of the intermediate codes. In other words, the maximum value is a maximum value of intermediate codes of respective dots in one common.

A common counter 20 counts the number of commons per one line, and indicates the completion of printing for one line. Furthermore, although the shape of the window frame M is described in the embodiments as to the inverted-T shape, the invention is not limited to this, and for example, a square window frame containing data of 9 dots for three lines, etc., may be used.

Hereinafter, the manner of determination of the preheating area in the first embodiment will be described in detail with reference to FIGS. 5B and 5C.

FIGS. 5B shows the window frame pattern M0 of the inverted T-shape detecting the non-printing area (specifically, the object dot area) to be preheated as mentioned before, and FIG. 5C shows a relationship between the window frame M and the printing data represented on a printing paper. In FIG. 5C, the abscissa represents the direction of movement or scanning of the window frame M, and the ordinate represents the order of lines to be printed downwardly. Further, in FIGS. 5B and 5C, each printing dot area for printing a vertical pattern line and for printing a horizontal line of a printing pattern of a grid shape is represented as 1, and a non-printing dot area in which no printing is made is represented as 0.

Figure 5C:
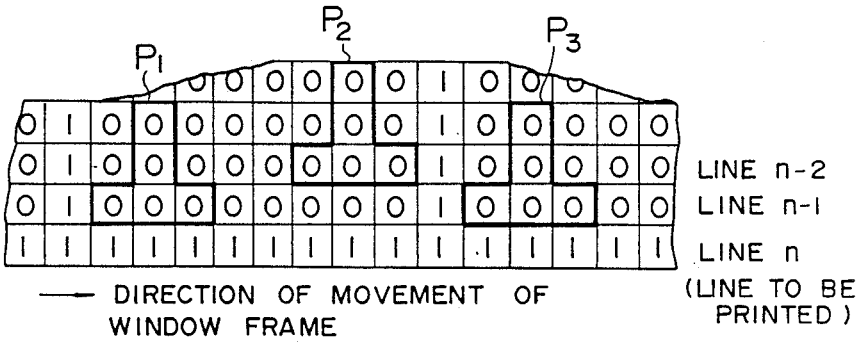
FIGS. 5C and 5F show examples of printing data assumed to be on a printing paper in relation to the window frame patterns.
Figure 5D:
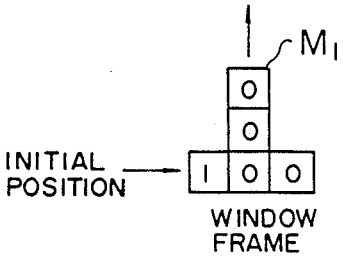
Figure 5E:
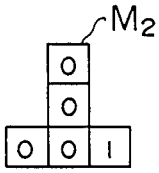

The window frame M of the inverted T-shape which covers three lines is shifted or moved dot by dot to the right in FIG. 5C, and after the scan of these three lines is completed, the window frame M is moved one dot line downwardly to scan the next three lines to determine whether the data or dot arrangement appearing in the window frame M coincides with the dot arrangement in the window frame pattern M0 containing all dots of 0. When the concidence is determined, the data coincident with the pattern M0, specifically, the dot area of the object dot is detected as the non-printing area (since the object dot of the frame M0 is 0) which is to be preheated.

For example, in the data areas indicated by P1, P2, and P3 in FIG. 5C which correspond to the window frame pattern M0, a dot area of the object dot in each of P1, P2, and P3 is preheated. In this case, a data area enclosed by the window frame M adjacent to the data area P1 at the left side thereof does not coincides with the pattern M0 because the left end of the dot row is 1. Thus, the dot area of the object dot which is 0 and located just at the right side of the column of 1 is not preheated. (This data area is preheated in the second embodiment.)

The intermediate code TM determined by the intermediate table 16 mentioned above is given by the following formula. Where, the total heating (application) time period is represented by KT, and the heating (application) time period per one time is represented by T0.

$$TM=K=KT/T0$$

Accordingly, for example, supposing that KT is 6 (for printing), and T0 is 1, then the intermediate code TM is 6. When KT is 1 (for preheating), the intermediate code is 1.

Figure 3:
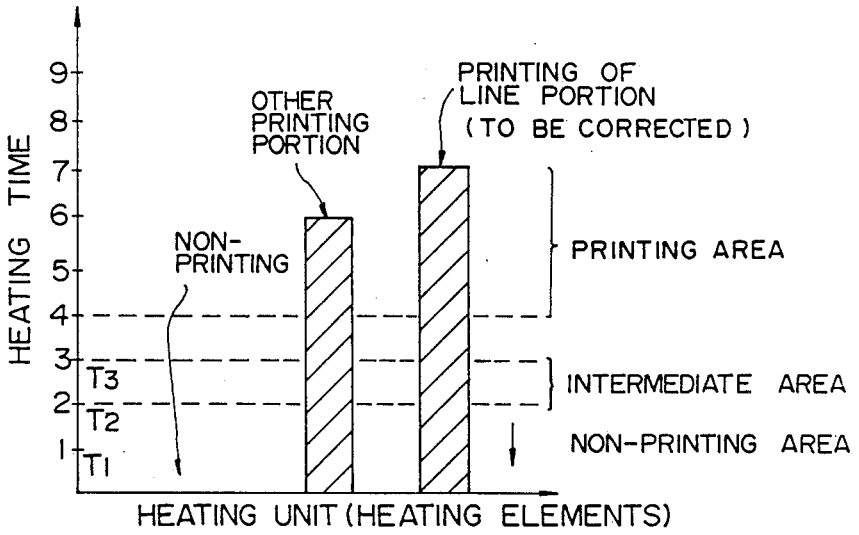
FIG. 3 is a graph illustrating a relationship between the heating time and printed conditions.

For example, as shown in FIG. 3, the intermediate code is set such that the total heating time per one common time for printing is 6, the preheating time is 1 in a non-printing area, and the heating time for non-printing without preheating is 0. In this manner, the intermediate code is determined for each area of one dot of the printing data, and the correction of the number of times of energization is performed for the dot area which is detected as coincident with the window frame pattern M0.

The comparator 19 compares the intermediate code signal B for each dot (the object dot in the window frame M, or the object dot in the window frame pattern M0 in the case of coincidence) which distinguishes the printing area (6), non-printing area (0), and preheating area (1) from one another as shown in FIG. 3 with the signal A ranging from 0 to 6 sequentially supplied from the energizing number counter 18, and produces an energizing signal including correction of heating when the window frame pattern M0 is detected.

For example, in the case of the printing area, when the signal B is equal to 6 of a maximum value, this numeral value 6 is compared sequentially with seven signals of 0, 1, 2, 3, 4, 5, and 6 which is supplied as the signal A sequentially each time the energization is performed.

Accordingly, from the comparator 19, the outputs of 1, 1, 1, 1, 1, 1, and 0 representing energizing signals are delivered sequentially, and six times of energization of the corresponding heating element is performed for the printing area.

Similarly, for the preheating area, a signal B of 1 is applied to the comparator 19 for the section of one common. Thus, this signal B is compared with a signal A which is applied in the order of 0 to 6 in a similar manner as for the printing area mentioned above, and energizing signals of 1, 0, 0, 0, 0, 0, and 0 are output sequentially for the section of one common, thereby to energize the heating element as preheating of one time of energization.

Furthermore, for the non-printing area requiring no preheating, a signal B of 0 is applied to the comparator 19. Thus, the energizing signals are all 0 for seven times, and no energization is performed.

The area to be corrected in heating as described above is an area (the object dot area) which coincides with the window frame pattern M0 designated by the intermediate table 16, for example, areas P1, P2, P3, etc. in FIG. 5C.

Accordingly, the energizing time of the heating element for the area adjacent to continuous non-printing areas excepting the non-printing areas just adjacent to the printing portion of the vertical pattern line at right and left sides thereof is adjusted with respect to the energizing time for the printing portion of the vertical pattern line so that a temperature difference between these portions becomes small thereby to prevent the thin or broken portion of the printed vertical line from appearing.

This operation is performed for each successive dot line.

In this case, a thermistor (not shown) provided on the thermal head S detects an environmental temperature and supplies a thermistor signal to an A/D converter 12 to adjust the preheating depending on a change in the environmental temperature. For example, this adjustment is made so that no actual printing is effected by the preheating due to high environmental temperature.

A driver circuit 8 controls driving of a paper feed pulse motor 9 and a transfer ribbon take-up pulse motor 10, and excitation of a thermal head pressing solenoid 11 in accordance with data supplied from the line counter 14 and commands supplied from the CPU 2.

The manner of preheating in the second embodiment will be described. FIGS. 5D and 5E show window frame patterns M1 and M2 for detecting areas (specifically, the object dot areas located at the center of the dot rows of the patterns M1 and M2) to be preheated used in the second embodiment, and FIG. 5F show a relationship between the printing data on a printing paper and the window frame patterns M1 and M2.

In the second embodiment, two window frame patterns M1 and M2 are used to detect the concidence between the printing data appearing in the window frame M and any one of the patterns M1 and M2 to perform correction of heating, that is, preheating of non-printing areas to prevent the occurrence of the thin or broken printed portion in the vertical printed line of the grid printing pattern.

Accordingly, by scanning the printing data by the window frame M, the printing data or dot arrangement which coincides with the patterns M1 and M2 are detected. For example, areas Q1 and Q2 shown in FIG. 5F in which the left end or the right end of the lower dot row is 1 and the other dots are 0 are detected. In other words, these areas Q1 and Q2 include non-printing areas, or the object dot areas of 0 respectively positioned just at the right and left adjacent sides of the printing portion of the vertical pattern line. These adjacent areas are omitted for preheating in the first embodiment.

Figure 5F:
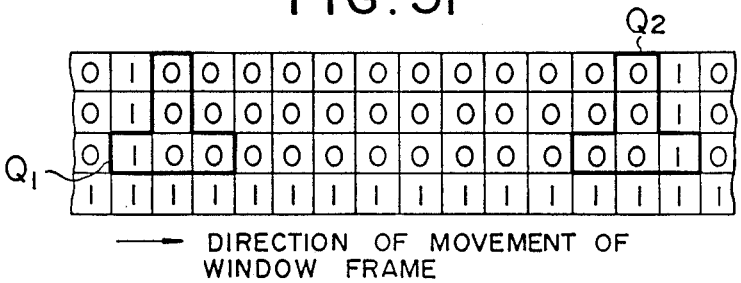

Thus, similar to the first embodiment, also referring to FIG. 4, the intermediate code signal B of "1", in the case of coincidence with the patterns M1 and M2, supplied to the comparator 19 from the intermediate table 16 through the intermediate code buffer 17 is compared with a signal A from the energizing number counter 18 to generates a preheating signal representing one time of energization to be effected as preheating to each dot of the non-printing areas just adjacent laterally to the vertical printing line, for example, shown in FIG. 5F at Q1 and Q2. As a result, the energizing time of the heating element for the printing portion of the vertical printing line and the energizing time for the non-printing portions (which are excluded in the first embodiment) just laterally adjacent to the vertical printing line are adjusted to decrease a temperature difference between these portions. By virtue of this, the occurrence of the thin or broken portion in the vertical printing line is prevented.

Figure 6A:
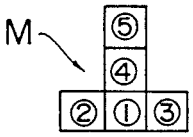
FIGS. 6A to 6F show a window frame and window frame patterns similar to FIGS. 5A, 5B, 5D and 5E.
Figure 6B:
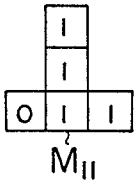
Figure 6C:
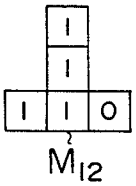
Figure 6D:
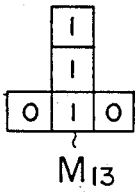
Figure 6E:
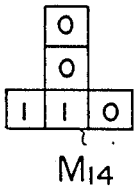
Figure 6F:
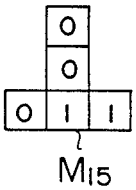
Figure 6G:
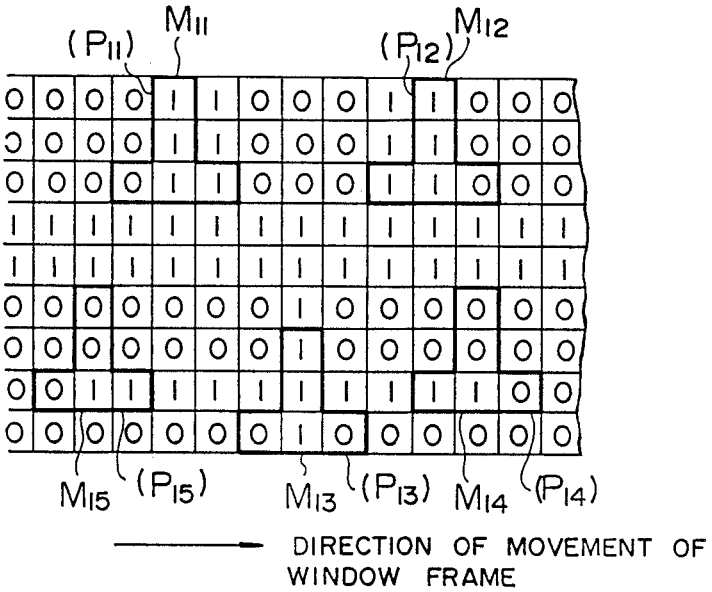
FIG. 6G shows printing data in relation to the window frame patterns assumed to be developed on a printing paper.

The manner of correction heating in the third embodiment will be described with reference to FIGS. 6A to 6F, and also FIG. 4. FIG. 6A shows a window frame M identical with that of FIG. 5A, and FIGS. 6B to 6F show respectively window frame patterns M11 to M15 which are used to emphasize or to correct heating particular portions of the vertical and horizontal printing lines. FIG. 6G shows, similar to FIGS. 5C and 5F, a relationship between each of the patterns M11 to M15 and printing data to be printed on a printing paper.

In this embodiment, the correction is made to the thin or broken printed portions of vertical and horizontal printing line portions which appear for the first time after continuous non-printing portions by detecting data areas coincident with the patterns M11 to M15.

Thus, in this case, similar to the first and second embodiments, when the printing data or dot arrangement appearing in the window frame M is determined as being coincident with any of the patterns M11 to M15 by the scanning by the window frame M, for example, P11 to P15 shown in FIG. 6G. The addresses of these coincident dot arrangements, for example, P11 to P15 are converted to intermediate codes by the intermediate table 16.

For example, in the case of the dot arrangement of P11 which coincides with the window frame pattern M11, the address is formed by 1, 0, 1, 1, 1, and the object dot area is 1 indicating the printing area. Thus, this address is converted to the intermediate code of 7. In this embodiment, all the intermediate codes for the P11 to P15 are set to 7 as will be described later. For the dot arrangement in the window frame M which does not coincide with any of the patterns M11 to M15, the intermediate code is set to 6 when the object dot indicates a printing area, whereas the intermediate code is set to 0 when the object dot indicates a non-printing area.

The intermediate code TM is expressed by the following formula similar to the one described in the first embodiment.

$$TM=K=KT/T0$$

Where, the intermediate code TM corresponds to the number of times of energization (heating) K, KT is the total energization (heating) time, and T0 is the energization (heating) time per one time.

Accordingly, for example, assuming that KT is 7, and T0 is 1, then the intermediate code TM equals 7.

The intermediate code is a corrected value to prevent the occurrence of the thin or broken printed portion, and for example, as shown in FIG. 3, the total heating time corrected for printing vertical and horizontal line portions is 7, and other printing portions not corrected is 6 so that the heating time is corrected to emphasize the line portion. In this manner, the intermediate code is determined for each dot area of the printing data, and the correction of heating time (the number of times of energization) is effected for the dot area of the object dot in the detected P11 to P15, etc.

The comparator 19 compares each intermediate code signal B for each dot distinguishing the printing of line portion (7), printing of other portions (6), and non-printing portion (0) from one another as shown in FIG. 3 with a signal A representing 0 to 7 sequentially supplied from the energizing number counter 18, and generates an energizing signal which has been corrected in the case of the intermediate code of 7.

For example, in the case of the printing of the pattern line portion, since the signal B represents a maximum value of 7, this numeral value 7 is compared with the signal A which is up counted or incremented by +1 each time the energization is made, that is, eight signals of 0, 1, 2, 3, 4, 5, 6, and 7 are supplied sequentially.

As a result, the energizing signals of 1, 1, 1, 1, 1, 1, 1, and 0 are output sequentially from the comparator 19 during the time interval of one common, and the corresponding heating element is energized for seven times to print the line portions to which the correction heating is to be made.

Similarly, for the printing of other portions to which no correction heating is required, since the signal B represents 6, the numeral value 6 is compared by the comparator 19 with eight signals of 0, 1, 2, 3, 4, 5, 6, and 7 sequentially supplied as the signal A similarly to the printing of the line portion.

Consequently, during the time interval of one common, energizing signals (comparator outputs) of 1, 1, 1, 1, 1, 1, 1, 0, and 0 are sequentially output to energize the heating element for six times of energization for this printing portion.

Furthermore, for a non printing portion, the signal B of 0 is supplied to the comparator 19, and thus, the eight energizing signals are all 0, and the heating of the heating element is not performed.

The areas to which the correction of energizing time is to be made are those which correspond to the window frame patterns M11 to M15, for example, P11, P12, P13, P14, P15, etc., as shown in FIG. 6G.

In these areas, the energizing time of the heating element is adjusted to extend the heating time by a predetermined time (in this embodiment, one energizing time period) as compared with a normal printing area so that the thin or broken printed line portion does not appear. This operation is performed for each of subsequent dot lines.

As described in the foregoing, in the first and second embodiments, the data to be printed is analyzed before the printing to determine the non-printing area to be preheated. Specifically, in the first embodiment, a continuous non-printing portion excepting both laterally adjacent non-printing portions to the vertical printing line is selected as the preheating area, and in the second embodiment, the both laterally adjacent non-printing portions to the vertical printing line (excluded in the first embodiment) is selected as the preheating areas.

Furthermore, in the third embodiment, a first dot line of each of the vertical and horizontal broad printing lines (respectively consisting of lines of a two-dot width) which is printed for the first time after continuous non-printing area is heated by correcting the heating time to increase the energizing time.

Accordingly, in the present invention, the following advantages are provided.

It is possible to print the grid pattern consisting of vertical and horizontal lines by preventing the occurrence of the thin or broken portion in the first printing portion, for example, a horizontal printing line which appears for the first time after the continuous non-printing area. Furthermore, the thin or broken printing portion in the vertical printing line caused by the preheating performed to prevent the thin or broken portion in the horizontal printing portion can be prevented.

Furthermore, it is possible to prevent the thin or broken portion in the first printing portion of each of broad vertical and horizontal lines in a grid pattern, which printing portion appears for the first time after a continuous non-printing portion, and clear printing can be achieved.

Furthermore, in the present invention, the area to be preheated or heated additionally as correction are detected by scanning the printing data by a window frame of a predetermined shape and by determining the coincidence of the data contained in the window frame with a predetermined window frame pattern stored in the memory. Since such operation is performed in software, no complicated circuitry is needed.

In addition, since the heating time by the heating unit is corrected by detecting the environmental temperature by a thermistor, clear printing can be attained independent of a change in the environmental temperature.

We claim:

1. A method for energizing a thermal head of a thermal printer comprising the steps of:

storing a plurality of lines of dots of printing data supplied from an external equipment in a plural line buffer;

extracting a predetermined number of dots on said plurality of lines in accordance with a window frame of a predetermined shape by scanning the printing data sequentially;

generating an address representing the predetermined number of dots extracted by said window frame;

determining whether the address corresponds to a predetermined window frame pattern or not;

converting both the address corresponding to said predetermined window frame and the address not corresponding thereto into intermediate codes by an intermediate code table, said intermediate codes respectively representing different amounts of heating energy to be supplied to a corresponding heating element of said heating unit depending on whether the address represents a printing area or non-printing area in the case the coincidence with said predetermined window pattern is determined, and whether the address represents a printing area or a non-printing area in the case the coincidence with the predetermined window pattern is not determined; and energizing the heating element of the heating unit in response to the intermediate code for the number of times to reach the amount of heating energy designated by the intermediate code.

2. An apparatus for energizing a thermal head of a thermal printer to print line by line the printing data representing a printing area and a non-printing area according to a printing pattern, said apparatus comprising:

a plural line buffer for storing the printing data supplied from an external equipment for a plurality of lines of dots of the printing data including the present line and preceding lines by sequentially transferring line by line;

a surrounding dot buffer receiving the printing data from said plural line buffer for forming a window frame of a predetermined shape, said window frame containing therein a predetermined number of dots for the plurality of lines including an object dot and its surrounding dots, said surrounding dot buffer generating an address for the predetermined number of dots contained in said window frame;

means including an intermediate code table for converting the address of the dots contained in said window frame into an intermediate code representing the amount of heating energy to be supplied to a heating element of said thermal head corresponding to the object dot in said frame window, said means determining as to whether the address representing the dot arrangement in said window frame is in coincidence with a dot arrangement of a predetermined window frame pattern which indicates preheating or correction heating so that said intermediate code distinguishes one from another a dot area to be non-heated when the address represents a non-printing area of the printing data, a dot area to be heated normally when the address represents a printing area, a dot area to be preheated when the address coincides with said window frame pattern and represents a non-printing area, and a dot area to be correction heated when the group of addresses coincides with said window frame pattern and represents a printing area of the printing data; and means for energizing the corresponding heating element of said thermal head in accordance with the intermediate code for the number of times until the amount of heating energy designated by said intermediate code is supplied to the heating element.

3. An apparatus according to claim 2 further comprising a comparator for comparing a signal representative of the energizing times incremented each time the energization is made with said intermediate code.

4. An apparatus according to claim 2, wherein said intermediate code is determined by a relation KT/TO, where KT is the total heating time for said thermal head, and TO is the heating time per one heating time.

5. An apparatus according to claim 3, wherein said comparator delivers an output including a series of energizing signals each representing a "1" level or "0" level.

* * * * *